US006607615B1

(12) United States Patent
Bekki et al.

(10) Patent No.: US 6,607,615 B1
(45) Date of Patent: Aug. 19, 2003

(54) EXTRUDED MATERIAL OF ALUMINUM ALLOY FOR STRUCTURAL MEMBERS OF AUTOMOBILE BODY AND METHOD OF MANUFACTURING THE SAME

(75) Inventors: Yoichiro Bekki, Tokyo (JP); Kazuhisa Kashiwazaki, Tokyo (JP); Nobuaki Ohara, Tokyo (JP); Noboru Hayashi, Wako (JP)

(73) Assignees: The Furukawa Electric Co., Ltd., Tokyo (JP); Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/331,966

(22) PCT Filed: Oct. 30, 1998

(86) PCT No.: PCT/JP98/04940

§ 371 (c)(1),
(2), (4) Date: Aug. 6, 1999

(87) PCT Pub. No.: WO99/23266

PCT Pub. Date: May 14, 1999

(30) Foreign Application Priority Data

Oct. 31, 1997 (JP) ..... 9-300504
Oct. 31, 1997 (JP) ..... 9-300542

(51) Int. Cl.[7] ..... C22C 21/02; C22F 1/047; B21C 25/00

(52) U.S. Cl. ..... 148/439; 148/689; 420/532

(58) Field of Search ..... 420/532; 148/689, 148/439

(56) References Cited

FOREIGN PATENT DOCUMENTS

| | | | |
|---|---|---|---|
| JP | 56-139667 | | 10/1981 |
| JP | 56-139667 A | | 10/1981 |
| JP | 58-31055 | | 2/1983 |
| JP | 61-190051 | | 8/1986 |
| JP | 3-87329 | | 4/1991 |
| JP | 3-87329 A | | 4/1991 |
| JP | 04297540 | * | 10/1992 |
| JP | 5-271834 | | 10/1993 |
| JP | 05271834 | * | 10/1993 |
| JP | 8-225874 | | 9/1996 |
| JP | 8225874 | * | 9/1996 |
| JP | 9-256095 | | 9/1997 |

* cited by examiner

*Primary Examiner*—Sikyin Ip
(74) *Attorney, Agent, or Firm*—Birch, Stewart, Kolasch & Birch, LLP

(57) ABSTRACT

There is disclosed an aluminum alloy extruded material for structural members of automotive bodies, which is composed of an aluminum alloy containing more than 2.6 wt % but 4.0 wt % or less of Si and more than 0.3 wt % but 1.5 wt % or less of Mg, further, (i) containing Mn, Zn, Cu, and Fe each in a given amount, or (ii) containing Zn, Cu, and Fe each in a given amount and containing at least one selected from among Mn, Cr, Zr, and V in a given amount, and the balance being made of Al and unavoidable impurities, which material has a given conductivity and a given melting start temperature. There is also disclosed a method for producing the extruded material, in which after an aluminum alloy ingot of the above composition is subjected to a homogenizing treatment at given conditions, it is cooled, heated again, and subjected to hot extrusion at given conditions. The extruded material is excellent in spot weldability and surface treatment property, such as the chemical conversion property and degreasing property, and it has high mechanical strength and ductility, and is excellent in impact absorbability and/or bendability.

18 Claims, No Drawings

EXTRUDED MATERIAL OF ALUMINUM ALLOY FOR STRUCTURAL MEMBERS OF AUTOMOBILE BODY AND METHOD OF MANUFACTURING THE SAME

This application is the national phase under 35 U.S.C. §371 of PCT International Application No. PCT/JP98/04940 which has an International filing date of Oct. 30, 1998, which designated the United States of America.

TECHNICAL FIELD

The present invention relates to aluminum alloy extruded materials for structural members of automotive bodies having excellent mechanical strength, impact absorbability, spot weldability, and surface treatment property, and that can be produced at low cost using, as a raw material, recycling aluminum materials, such as recycled aluminum cast scraps of automobiles and aluminum can scraps. The present invention also relates to a method for producing the aluminum alloy extruded materials.

Further, the present invention relates to aluminum alloy extruded materials for structural members of automotive bodies having excellent mechanical strength, bendability, spot weldability, and surface treatment property, and that can be produced at low cost using, as a raw material, recycling aluminum materials, such as recycled aluminum cast scraps of automobiles, recycled aluminum scraps of aluminum cans, and recycled aluminum scraps of aluminum sashes. The present invention also relates to a method for producing the aluminum alloy extruded materials.

BACKGROUND ART

Many structural members of automobiles are complicated in shape and are hollow, and since aluminum alloy materials are light in weight and more suitable for extrusion than other materials, use of extruded materials of aluminum alloys as structural members of automotive bodies is now studied. The extruded materials of aluminum alloys are especially suitable since they are not only light but also highly rigid, and then they can absorb energy at the time of a collision through crushing themselves increasing safety.

However, the materials conventionally used in such aluminum alloy extruded materials are mainly 6000-series aluminum alloys, such as 6063 aluminum alloy, and since 6000-series aluminum alloys have relatively low mechanical strength and impact-absorption energy, in comparison with other materials, they have the problem that it is required to increase the thickness of the material shaped. Further, they have the problem that they have poor bendability; that is, when these alloys are subjected to severe bending, cracks occur. Furthermore, there are other problems; for example, the spot weldability is low, requiring a very large electric current for spot welding in the assembling process for automobiles, thereby lowering productivity; and the degreasing property and the chemical conversion property, for example, in the case for surface coating, are poor, thereby making it difficult to secure a coating with good durability. Among structural members of automobiles, particularly those called structural members for bodies, such as side frames, rear frames, center pillars, side sills, and floor frames, are fixed, for example, by spot welding, and they are also exposed to the outside environment, as well as to a corrosive environment, including muddy water. Therefore, the structural members for the bodies are materials that essentially require the chemical conversion susceptivity, since, for example, they are covered by coating for improving the corrosion resistance.

However, hitherto, materials that have various performance properties required for structural members of automotive bodies, such as workability, spot weldability, and surface treatment property, and extrudability and mechanical strength, required for aluminum alloys, and that are also excellent in recycling ability, have not yet been developed.

(i) Although, for example, JP-A-58-31055 ("JP-A" means unexamined published Japanese patent application) discloses an aluminum alloy for structure improved in mechanical strength, weldability, and cutting ability/machinability, which comprises 2.3 to 6% by weight of Si, 0.4 to 1.0% by weight of Mg, 0.4 to 1.0% by weight of Mn, small amounts of Zn and Sn, and the balance being made of Al, it is not satisfactory in bendability and spot weldability, and it is greatly different from the present invention, in that it is not one wherein both elements of Cu and Zn are contained, whereby the melting temperature of the aluminum alloy is lowered and the spot weldability and the chemical conversion property (zinc phosphatability (the property of being attached with zinc phosphate)) at the time of pretreatment for coating or the like are improved.

(ii) Further, although JP-A-61-190051 discloses a process for the production of an Al-series hollow extruded material, wherein use is made of an aluminum alloy containing 5 to 15% by weight of Si, and up to 1.0% by weight of Mg, and having an Fe content of 0.5% by weight or less, with Cu, Mn, etc., amounting to 0.25% by weight or less, this aluminum alloy is larger in the amount of added Si than the present invention, and it is an alloy improved in heat resistance and wear resistance properties, such that it is used for high-temperature exposure members of automobiles, rod materials for slide members, and thick extrusion-shape materials, but it is low in spot weldability and surface treatment property, such as zinc phosphatability, and it lacks extrudability. Accordingly, this material is not one that can be used as an extruded material for body structures, as the present invention can.

(iii) Further, JP-A-5-271834 discloses an aluminum alloy fine in crystal grains and stable in artificial aging, which contains 0.2 to 1.2% by weight of Mg, and 1.2 to 2.6% by weight of Si, with the value of {Si (% by weight)—Mg (% by weight)/1.73} being over 0.85 but less than 2.0, and the balance being made of Al. This is an alloy whose composition ratio of Mg to Si is such that Si is in excess in terms of stoichiometric composition, thereby allowing $Mg_2Si$ to be formed readily. This is an alloy whose component ranges of Mg and Si in the compositions of conventional JIS 6N01 alloys and AA6005 alloys are simply increased, and the extrudability is excellent, but other properties, i.e. the spot weldability and the surface treatment property, are not satisfactory.

(iv) Furthermore, JP-A-8-225874 describes an aluminum alloy extruded material for automotive structural members that contains 0.5 to 2.5% by weight of Si, 0.2 to 1.0% by weight of Fe, 0.45 to 1.5% by weight of Zn, 0.05 to 1.0% by weight of Cu, and 0.4 to 1.5% by weight of Mn. Although this extruded material is excellent in extrudability, mechanical strength, and surface treatment property, the electrical resistance of the material is low, and the spot weldability is still problematic. That is, in the spot welding in the mass production line of structural members of automotive bodies, the wearing of the welding electrode tip is a problem, and, as the wearing of the electrode tip progresses, the texture of the welded part becomes unstable and the nugget size changes, thereby lowering the strength of the welded part. Therefore, the electrode tip must be replaced frequently, which is a prime cause to adversely affect productivity in the mass production line, and hence the wearing of the welding electrode tip is a prime problem involved in spot welding.

Furthermore, in recent years, in view of environmental problems, effective exploitation of resources, and the like, the importance of recycling of used products is on the increase, leading to activities for legislation to make the recycling of automotive parts obligatory. Hence and the reuse of metal scrap is also being studied in various ways. In particular, there is a need for an established technique for regenerating high-quality materials from recycled aluminum cans, from recycled scraps of aluminum sashes, and from scraps of abandoned automobiles.

Accordingly, an object of the present invention is to provide an aluminum alloy extruded material for structural members of automotive bodies that is excellent in spot weldability and surface treatment property, such as the chemical conversion property and degreasing property, that has high mechanical strength and ductility, and that has excellent impact absorbability.

Further, another object of the present invention provides a method for the production of an aluminum alloy extruded material for structural members of automotive bodies that has excellent spot weldability, surface treatment property, and impact absorbability.

Further, still another object of the present invention provides an extruded material for structural members of automotive bodies that has excellent properties as described above, and that can be produced by using recycled scraps of aluminum cans or recycled scraps of automotive aluminum parts, as a raw material.

Further, another object of the present invention provides an aluminum alloy extruded material for structural members of automotive bodies that has excellent spot weldability and surface treatment property, such as the chemical conversion property and degreasing property, that has high mechanical strength and ductility, and that is excellent in bendability.

Further, still another object of the present invention is to provide a method for the production of such an aluminum alloy extruded material for structural members of automotive bodies that has excellent spot weldability, surface treatment property, and bendability.

Further, another object of the present invention provides an extruded material for structural members of automotive bodies that has excellent properties as described above, and that can be produced by using recycled scraps of aluminum sashes or scraps of automotive aluminum parts, as a raw material.

Other and further objects, features, and advantages of the invention will appear more fully from the following description.

DISCLOSURE OF INVENTION

In view of the above objects, the inventors of the present invention, having investigated intensively, have found that the above objects can be attained by providing an extruded material obtained by using an aluminum alloy having a specified composition, subjecting the aluminum alloy to a homogenizing treatment under specified conditions, and then hot rolling it. Based on this finding, the present inventors completed the present invention.

That is, according to the present invention, there are provided:

(1) An aluminum alloy extruded material for structural members of automotive bodies, which is composed of an aluminum alloy (hereinafter referred to as the first aluminum alloy) containing more than 2.6% by weight (hereinafter "% by weight" being referred simply to as %) but 4.0% or less of Si, more than 0.3% but 1.5% or less of Mg, more than 0.3% but 1.2% or less of Mn, more than 0.3% but 1.2% or less of Zn, more than 0.2% but 1.2% or less of Cu, and more than 0.1% but 1.5% or less of Fe, and the balance being made of Al and unavoidable impurities, having the conductivity of 48% or less based on the IACS and the melting start temperature of 570° C. or less;

(2) An aluminum alloy extruded material for structural members of automotive bodies, which is composed of an aluminum alloy (hereinafter referred to as the second aluminum alloy) containing more than 2.6% by weight but 4.0% by weight or less of Si, more than 0.3% by weight but 1.5% by weight or less of Mg, more than 0.3% by weight but 1.2% by weight or less of Zn, more than 0.3% by weight but 1.2% by weight or less of Cu, and more than 0.1% by weight but 1.5% by weight or less of Fe, and containing at least one selected from among Mn in an amount of more than 0.01% by weight but 0.3% by weight or less, Cr in an amount of more than 0.01% by weight but 0.3% by weight or less, Zr in an amount of more than 0.01% by weight but 0.3% by weight or less, and V in an amount of more than 0.01% by weight but 0.3% by weight or less, and the balance being made of Al and unavoidable impurities, having the conductivity of 50% or less based on the IACS and the melting start temperature of 570° C. or less;

(3) The aluminum alloy extruded material for structural members of automotive bodies as stated in the above (1) or (2), wherein said aluminum alloy further contains Sr or Sb in an amount of 50 to 500 ppm;

(4) A method for producing the aluminum alloy extruded material for structural members of automotive bodies stated in the above (1), (2), or (3), wherein after an aluminum alloy ingot is subjected to a homogenizing treatment at a billet temperature of over 520° C. but 570° C. or less for 1 hour or more, it is subjected to a homogenizing treatment by keeping it at a temperature of over 400° C. but 520° C. or less for 1 hour or more, and thereafter it is cooled, heated again, and subjected to hot extrusion at a billet temperature of over 330° C. but 500° C. or less;

(5) The method for producing the aluminum alloy extruded material for structural members of automotive bodies as stated in the above (4), wherein at least a part of the material-sliding-surface of the extrusion die is coated with ceramics;

(6) An aluminum alloy extruded material for structural members of automotive bodies produced by the production method as stated in the above (4) or (5), wherein scraps recycled from aluminum cans containing more than 0.5% but 1.2% or less of Mn and more than 1.2% but 2.0% or less of Mg and scraps of automotive aluminum parts containing more than 2.5% but 14% or less of Si are used for at least a part of the aluminum alloy ingot, with the proviso that the aluminum alloy is the above first aluminum alloy; and (7) An aluminum alloy extruded material for structural members of automotive bodies produced by the production method as stated in the above (4) or (5), wherein scraps recycled from aluminum sashes containing more than 0.2% by weight but 1.0% by weight or less of Mg and scraps of automotive aluminum parts containing more than 2.5% by weight but 14% by weight or less of Si are used for at least a part of the aluminum alloy ingot, with the proviso that the aluminum alloy is the above second aluminum alloy.

Herein, unless otherwise specified, the aluminum alloy used in the present invention includes both the above first and second aluminum alloys.

BEST MODE FOR CARRYING OUT THE INVENTION

The first aluminum alloy used in the present invention contains more than 2.6% but 4.0% or less and preferably 2.6 to 3.5% of Si, more than 0.3% but 1.5% or less and preferably 0.3 to 0.8% of Mg, more than 0.3% but 1.2% or less and preferably 0.3 to 0.8% of Mn, more than 0.3% but 1.2% or less and preferably 0.3 to 0.8% of Zn, more than 0.2% but 1.2% or less and preferably 0.2 to 0.8% of Cu, and more than 0.1% but 1.5% or less and preferably 0.1 to 1.0% or less of Fe.

On the other hand, the second aluminum alloy used in the present invention contains more than 2.6% by weight but 4.0% by weight or less and preferably 2.6 to 3.5% by weight of Si, more than 0.3% by weight but 1.5% by weight or less and preferably 0.3 to 0.8% by weight of Mg, more than 0.3% by weight but 1.2% by weight or less and preferably 0.3 to 0.8% by weight of Zn, more than 0.3% by weight but 1.2% by weight or less and preferably 0.3 to 0.8% by weight of Cu, and more than 0.1% by weight but 1.5% by weight or less and preferably 0.1 to 1.0% by weight of Fe, and it further contains at least one selected from among Mn, Cr, Zr, and V with each content amounting to more than 0.01% by weight but 0.3% by weight or less.

The action of each of elements in the aluminum alloy material of the present invention is described.

Si increases the mechanical strength of the aluminum alloy material, as well as secures the required elongation and acts to increase the impact absorption energy. If its content is less than 2.6%, its action is insufficient, whereas if its content is more than 4.0%, the extrusion becomes difficult. Herein the impact absorption energy means the energy that can be absorbed by the compression, the elongation deformation, or the like, and it is evaluated, in the present invention, by the deformation energy required until it is broken in the tensile test. Preferably this value is 0.035 $Nm/mm^2$ or more, and more preferably 0.04 $Nm/mm^2$ or more.

Further, Mg acts to form an intermetallic compound with the above Si, $Mg_2Si$ (precipitate), to improve the strength. If the amount of Mg is too small, its effect is insufficient, whereas if the amount is too large, the extrudability deteriorates.

Zn lowers the melting point of the alloy to improve the spot weldability, as well as increases the surface reactivity, thereby improving the surface treatment property, such as the degreasing property and the chemical conversion property. When Zn is increased in conventional aluminum alloy extruded materials for automotive structural members, a difficulty arises that the self-corrosion-resistance is deteriorated. On the other hand, in the composition of the present invention, since the surface coating is applied, that difficulty is prevented, by widening the allowable range where the self-corrosion resistance is lowered. If the amount of Zn is too small, the spot surface treatment property becomes unsatisfactory and the chemical conversion property is made poor, while if the amount is too large, the corrosion resistance deteriorates.

Cu increases the mechanical strength of the alloy and at the same time lowers the electrical conductivity and the melting point, to improve the spot weldability. Further, it also serves to improve the impact absorption energy by an increase in the strength of the alloy. If the amount of Cu is too small, its action becomes insufficient, while if the amount is too large, the extrusion becomes difficult.

Further, Fe has an action for improving the toughness by refining the crystal grains and an action for increasing the impact absorption energy. If the amount of Fe is too small, its action becomes insufficient, while if the amount is too large, due to the large crystallized phase, the extrudability becomes deteriorated and the impact absorption energy is lowered.

In the first aluminum alloy, Mn increases the mechanical strength, to improve the impact absorption energy. If the amount of Mn is too small, its action becomes insufficient, while if the amount is too large, it forms a large crystallized phase of Al—Mn, thereby lowering the impact absorption energy and the extrudability.

Further, in the second aluminum alloy, Fe in the above proportion, and the elements selected from among Mn, Cr, Zr, and V, have an effect for improving the moldability and the toughness of the alloy by making the crystal grains fine, and as a result improving the bendability.

In the present invention, Sr or Sb may be contained in an amount of 50 to 500 ppm in the aluminum alloy if necessary. This Sr or Sb acts to make the Si grains in the above aluminum alloy fine. If the added amount of Sr or Sb is 50 ppm or less, the refining effect (effect on refining) is insufficient, while if the amount is over 500 ppm, the refining effect is not obtained and it becomes in a so-called overmodification state. Therefore, these elements are added in an amount of 50 to 500 ppm and preferably about 50 to 300 ppm.

Further, to make the Si grains fine, in some cases, Na is used in place of Sr or Sb, but since it causes cracks at the time of hot extrusion, it is not used as far as possible, and use of Sr or Sb is desirable. Although, in view of the refining treatment of Si grains, Na in an amount of about 150 ppm at most is considered sufficient, taking the hot cracking at the time of extrusion into consideration, it is necessary that the amount of its use should be a fraction thereof.

Further, the conductivity of the aluminum alloy extruded material of the present invention is 48% or less based on the IACS and preferably 46% or less based on the IACS in the case wherein the first aluminum alloy is used, and it is 50% or less based on the IACS and preferably 49% or less based on the IACS in the case wherein the second aluminum alloy is used, and the melting start temperature is 570° C. or less and preferably 560° C. or less. Because of the lower conductivity and the lower melting start temperature, the spot welding in the process for assembling automobile bodies does not require a large electric current and also the electrode tip life can be improved considerably. Therefore, an extruded material for structural members of automotive bodies is made possible that allows spot welding with the welding quality of spot welded parts and the productivity of the welding line secured.

The aluminum alloy extruded material for structural members of automotive bodies of the present invention can be manufactured by subjecting an aluminum alloy ingot having the above composition to a homogenizing treatment under specified conditions, then cooling it, reheating it, and subjecting it to hot extrusion at a prescribed temperature.

The homogenizing treatment at that time can be carried out using any one of (1), (2), or (3): that is, (1) a homogenizing treatment at a temperature of over 450° C. but 520° C. or less for one hour or more, (2) a homogenizing treatment at a billet temperature of over 520° C. but 570° C. or less for one hour or more, or (3) a homogenizing treatment at a billet temperature of over 520° C. but 570° C. or less for one hour or more followed by keeping it at a temperature of over 400° C. but 520° C. or less for one hour or more.

The homogenizing treatment at a temperature of over 450° C. causes $Mg_2Si$ to precipitate, which lowers the flow stress. Further if the homogenizing treatment at a high temperature of over 520° C. is carried out, the Mn-series precipitation is made coarse, whereby the high-temperature flow stress in the presence of Mg is lessened and the upper limit of the extrusion speed can be elevated.

The homogenizing treatment at a temperature of over 400° C. but 520° C. or less causes $Mg_2Si$ to precipitate, which can further decrease the flow stress, whereby the upper limit of the extrusion speed is further increased.

Further, if the billet heating temperature is too low, the pressure becomes too excessive to carry out the extrusion. If it is too high, the generation of the processing heat at the time of the extrusion causes melting.

The production of the aluminum alloy extruded material for structural members of automotive bodies of the present invention is characterized in that the extrusion speed can be increased more than that of the conventional method. Further, when a part or all of the material sliding surface of the extrusion die is coated with ceramics, the friction resistance is lowered, enabling the upper limit of the speed of the extruded material to be improved by about 20%, which is preferable. More preferably, the ceramics coating is applied to the part having a clearance of at least 3 mm or less, or to all the surface of the die (bearing).

As described above, by subjecting the aluminum alloy ingot having a specified composition to the homogenizing treatment at a specified temperature and an extrusion process, improvement is made with respect to the occurrence of cracks at the time of the extrusion, the excessive extrusion load, and the like, thus that gives increase in the productivity. The cause of the cracks at the time of the extrusion is assumed in such a way that the difference in metal flow causes the speeds at different parts to be different, to result in internal shearing forces in the extruded material and such a tension leads to breakage. In particular, in the case of a hollow member having a center pillar, since a difference in speed is liable to occur from site to site and the generation of processing heat is generally large, the possibility of the generation of cracks is high. On the other hand, according to the method of the present invention, a member having such a shape can be produced at a high extrusion speed without generating cracks.

When the first aluminum alloy is used, although the alloy for use in the present invention is liable to have cracks at the time of hot extrusion thereby leading to a risk of deteriorating the productivity, cracks can be obviated by carrying out the extrusion at a speed determined from the below-shown relationship between the homogenizing treatment and the shape of the extruded material. (V represents the extrusion speed (m/min), and T represents the billet temperature (° C.) at the time of the start of the extrusion.)

(1) In the case wherein the homogenizing treatment is carried out at a temperature of more than 450° C. but 520° C. or less for 1 hour or more:

A hollow member with a center pillar: $V<14,000/T$

A hollow member with no center pillar and a solid member: $V<20,000/T$;

(2) In the case wherein the homogenizing treatment is carried out at a temperature of more than 520° C. but 570° C. or less for 1 hour or more:

A hollow member with a center pillar: $V<15,000/T$

A hollow member with no center pillar and a solid member: $V<22,000/T$;

(3) In the case wherein the homogenizing treatment is carried out at a temperature of more than 520° C. but 570° C. or less for 1 hour or more, followed by keeping it at a temperature of more than 400° C. but 530° C. or less for 1 hour or more:

A hollow member with a center pillar: $V<16,000/T$

A hollow member with no center pillar and a solid member: $V<24,000/T$

As is described above, the extrusion speed is excellent in the order of (3), (2), and (1).

Further, when the second aluminum alloy is used, there is no particular restriction on the speed of the hot extrusion in the present invention, but the below-shown speed given by the relationship between the homogenizing treatment and the shape of the extruded material is particularly preferable. (V represents the extrusion speed (m/min), and T represents the billet temperature (° C.) at the time of the start of the extrusion.)

(1) In the case wherein the homogenizing treatment is carried out at a temperature of more than 450° C. but 520° C. or less for 1 hour or more:

A hollow member with a center pillar: $V<16,000/T$

A hollow member with no center pillar and a solid member: $V<22,000/T$;

(2) In the case wherein the homogenizing treatment is carried out at a temperature of more than 520° C. but 570° C. or less for 1 hour or more:

A hollow member with a center pillar: $V<17,000/T$

A hollow member with no center pillar and a solid member: $V<23,000/T$;

(3) In the case wherein the homogenizing treatment is carried out at a temperature of more than 520° C. but 570° C. or less for 1 hour or more, followed by keeping it at a temperature of more than 400° C. but 530° C. or less for 1 hour or more:

A hollow member with a center pillar: $V<18,000/T$

A hollow member with no center pillar and a solid member: $V<24,000/T$

As is described above, the extrusion speed is excellent in the order of (3), (2), and (1).

In the method for producing an aluminum alloy extruded material for structural members of automotive bodies of the present invention, one of the features is that aluminum cans, aluminum sashes, and aluminum layers of abandoned automobiles can be recycled to use.

Since in the present invention, the first aluminum alloy used contains much Si, Mn, and Zn, and the second aluminum alloy used contains much Si and Zn, various metal scraps can be recycled and utilized as its raw material. Usable recycled scraps include, for example, recycled aluminum cans, aluminum sash scraps, and part scraps including engine scraps of automobiles. Preferably, a recycled material, such as recycled aluminum can scraps containing more than 0.5% but 1.2% or less of Mn and more than 1.2% but 2.0% or less of Mg, recycled aluminum sash scraps containing more than 0.2% but 1.0% or less of Mg, and automotive aluminum-part scraps containing more than 2.5% but 14% or less of Si, are used as part of the raw material. In this case, the recycled material is subjected to a purification treatment if necessary. The purification treatment can be carried out in a usually practiced manner, for example, by the α-phase (α-solid-solution) separating treatment. Such a purification treatment is known per se and is described, for example, in JP-A-7-54061 and JP-A-7-197140, which can be followed.

By using the scraps as described above, the impact absorption energy of the obtained member can be increased. Further, these scraps are relatively easily available and lead to a reduction in cost of the member.

When the first aluminum alloy is used, since the aluminum alloy extruded material for structural members of automotive bodies of the present invention is low in conductivity and melting start temperature, the electrode tip is less worn at the time of spot-welding, and therefore the improvement in the productivity in the assembling process can be attained; further since the degreasing property and the chemical conversion property are good, the surface treatment property is excellent, and in addition since the strength is high and the impact absorption energy is large, such an excellent effect can be exhibited that the thickness can be made decreased. This aluminum alloy extruded material can be used, as a structural member of automotive bodies, in the application where both the spot weldability and the surface treatment property are required, such as a side frame, a rear frame, a center pillar, a side sill, and a floor frame.

Further, when the second aluminum alloy is used, since the aluminum alloy extruded material for structural members of automotive bodies of the present invention is low in conductivity and melting start temperature, the electrode tip is less worn at the time of spot-welding, and therefore the improvement in the productivity in the assembling process can be attained; further since the degreasing property and the chemical conversion property are good, the surface treatment property is excellent, and in addition since the strength is high and the bendability is high, such an excellent effect can be exhibited that cracks are not formed even in high-degree (severe) bending. This aluminum alloy extruded material can be used, as a structural member of automotive bodies, in the application where both the spot weldability and the surface treatment property as well as the bendability are required, such as a side frame, a rear frame, a center pillar, a side sill, and a floor frame.

Further, according to the production method of the present invention, an extruded material without cracks can be produced at a high extrusion speed with good productivity. Further, the aluminum alloy extruded material for structural members of automotive bodies of the present invention can be produced with a high quality at a low cost using recycled aluminum can scraps, recycled aluminum sash scraps, automotive aluminum part scraps, and the like.

EXAMPLES

Now, the present invention is described in more detail based on the following examples, which do not limit the invention.

As is shown in Tables 4 and 5, aluminum alloys, respectively having the compositions of 1A to 1I shown in Table 1, were subjected to soaking and extruding under the conditions of I to VI shown in Table 3, to carry out production tests of aluminum alloy extruded material Samples 1 to 15. After cooling with air using a fan at the time of the extrusion, the samples each were subjected to aging at 180° C. for 2 hours, and then the following properties were evaluated. The results are shown in Tables 4 and 5.

Additionally stated, the compositions of ADC12Z, UBC, and AC4CH used in 1A to 1C in Table 1 are as shown in Table 2, and the purification was carried out by the α-phase separating treatment method.

The methods for testing the properties were as follows:

(1) The Tensile Test (the Tensile Strength, the Proof Stress, and the Elongation Value)

JIS No. 5 Test Piece was used and the test was carried out using an Instron-type tensile tester at a tensile rate of 10 mm/min, to find the tensile strength, the proof stress, and the elongation value.

(2) The Impact Absorption energy

The impact absorption energy refers to energy that can be absorbed by the plastic deformation of the extruded material caused, for example, by the stretching and the compression, and it was found as the deformation energy required until it was broken by the tensile test.

(3) The Conductivity

The conductivity was measured by the eddy current method using a measuring apparatus that was adjusted using a standard test piece, and it was expressed in % based on the IACS.

(4) The Melting Start Temperature

The melting start temperature was found by carrying out the thermal analysis by the DSC method at a heating rate of 20° C./min.

(5) The Deposited Amount of Zinc Phosphate

The zinc phosphatizing was carried out in such a manner that using commercially available agents manufactured by Nihon Parkerizing Co., Ltd. in respective steps,.the test piece of a size 70 mm×150 mm was degreased, the pretreatment for the surface control was carried out, and then the zinc phosphatising was carried out. In the treatment steps, after carrying out the degreasing with a decreasing agent (trade name: FC-L4460) at 43° C. for 2 min and the pretreatment with a surface control agent (trade name: PL-4040) at room temperature for 30 sec, the zinc phosphatising was carried out using a zinc phosphatising agent (trade name: PB-L3020) at 43° C. for 2 min, and thereafter the deposited weight of zinc phosphate per unit area was measured after washing with water and drying.

(6) The Spot Weldability

The spot welding was carried out by a single phase rectification welder using a 1% Cr-Cu R-type electrode tip R=150 under a welding force of 3923 N (400 Kgf) and a welding current of 30 KA. Meantime, the spot welding was carried out in such a manner that after the welding force was kept for a certain period of time, during which the welding current was applied to retain a certain welding current for a certain period of time, the welding force was further kept until the nugget part of the material was solidified entirely after the completion of the application of the welding current.

Herein, the time required until the welding current was secured (squeeze time) after the application of the welding force was rated 35 cycles (0.70 sec), the time required for melting the material by keeping a certain electric current (welding time) was rated 12 cycles (0.24 sec), the holding time after the completion of the application of the electric current was rated 15 cycles (30 sec), and the welding took 3 sec for one spot. Thus, when the tensile shear load reached 3,000 kN or less, it was evaluated that the electrode tip life expired.

(7) The Bendability

After carrying out 90°-V-shaped bending (apex R: 2 mm), one in which no cracks appeared was evaluated to be "good" and one in which cracks appeared was evaluated to be "inferior".

TABLE 1

| Type | | Composition (wt %) | | | | | | | | | | Remarks |
|---|---|---|---|---|---|---|---|---|---|---|---|---|
| | | Cu | Fe | Si | Mn | Mg | Cr | Ti | Zn | Sr | Al | |
| Example of this invention | 1A | 0.45 | 0.35 | 2.90 | 0.50 | 0.43 | 0.05 | 0.01 | 0.51 | — | balance | ADC12Z, UBC mixed/purified |
| | 1A' | 0.45 | 0.35 | 2.90 | 0.50 | 0.43 | 0.05 | 0.01 | 0.51 | 100 ppm | balance | ADC12Z, UBC mixed/purified |
| | 1B | 0.33 | 0.35 | 2.70 | 0.32 | 0.55 | 0.04 | 0.01 | 0.33 | — | balance | ADC12Z, UBC ground metal-mixed/purified |
| | 1C | 0.98 | 0.85 | 3.89 | 0.88 | 0.75 | 0.07 | 0.01 | 0.34 | — | balance | AC4CH, UBC mixed |
| | 1D | 0.40 | 0.25 | 2.65 | 0.40 | 0.40 | 0.03 | 0.03 | 0.30 | — | balance | |
| | 1E | 1.10 | 1.35 | 3.95 | 1.10 | 1.40 | 0.10 | 0.03 | 1.10 | — | balance | |
| Comparative Example | 1F | 0.45 | 0.33 | 2.20 | 0.01 | 0.35 | 0.03 | 0.00 | 0.00 | — | balance | |
| | 1G | 0.01 | 0.23 | 0.34 | 0.01 | 0.45 | 0.02 | 0.01 | 0.00 | — | balance | |
| | 1H | 0.43 | 0.33 | 2.80 | 0.45 | 0.45 | 0.03 | 0.01 | 0.20 | — | balance | |
| | 1I | 1.4 | 0.75 | 5.00 | 0.85 | 0.76 | 0.05 | 0.01 | 0.30 | — | balance | |

TABLE 2

| Type | Composition (wt %) | | | | | | | | |
|---|---|---|---|---|---|---|---|---|---|
| | Cu | Fe | Si | Mn | Mg | Cr | Ti | Zn | Al |
| ADC12Z | 2.1 | 1.15 | 11.7 | 0.31 | 0.16 | 0.01 | 0.01 | 1.83 | balance |
| AC4CH | 0.11 | 0.13 | 7.0 | 0.01 | 0.38 | 0.03 | 0.01 | 0.05 | balance |
| UBC | 0.11 | 0.38 | 0.07 | 0.78 | 1.48 | 0.01 | 0.01 | 0.00 | balance |

TABLE 3

| | Production method | | | | | |
|---|---|---|---|---|---|---|
| | I | II | III | IV | V | VI |
| Homogenizing treatment | 530° C. × 4 hours | | | 540° C. × 4 hours + 450° C. × 4 hours | 530° C. × 4 hours | |
| Die * | hollow 1 | solid/ hollow 2 | hollow 1/ TiN coat | hollow 1 | hollow 1 | hollow 1 |
| Extrusion billet temperature | 400° C. | 450° C. | 400° C. | 400° C. | 300° C. | 520° C. |
| Extrusion speed | 45 mpm | 40 mpm | 48 mpm | 52 mpm | — | 38 mpm |
| Extrusion state | good | good | good | good | Extrusion was impossible | Cracks appeared |

(注) * Die
Hollow 1: B-shaped, 40 mm on each side, 2.0 mm in thickness, made of a high speed steel
Hollow 2: Square, 40 mm on each side, 2.0 mm in thickness, made of a high speed steel
Solid: 2.0 t × 100 W
TiN coat: The bearing part had a coating of 1 μm in thickness, and the ground material was a high speed steel.

TABLE 4

| | | Example of this invention Sample No. | | | | | | | | |
|---|---|---|---|---|---|---|---|---|---|---|
| | | 1 | 2 | 3 | 4 | 5 | 6 | 7 | 8 | 9 |
| Alloy | | 1A | 1A' | 1B | 1C | 1D | 1E | 1A | 1A | 1A |
| Production method | | I | I | I | I | I | I | II | III | IV |
| Extrusion result | | good | good | good | good | good | good | good | good | good |
| Property | Tensile strength (MPa) | 320 | 323 | 310 | 330 | 309 | 365 | 321 | 320 | 318 |
| | Proof stress (MPa) | 245 | 249 | 235 | 252 | 230 | 278 | 245 | 246 | 243 |
| | Elongation (%) | 14.5 | 15.6 | 15.0 | 14.0 | 15.0 | 13.8 | 14.4 | 14.3 | 14.9 |
| | Bendability | good | good | good | good | good | good | good | good | good |
| | Impact absorption energy ($Nm/mm^2$) | 0.041 | 0.044 | 0.041 | 0.041 | 0.041 | 0.041 | 0.041 | 0.041 | 0.042 |
| | Conductivity (IACS %) | 46 | 46 | 47 | 45 | 47 | 44 | 46 | 46 | 47 |
| | Melting start temperature (° C.) | 560 | 560 | 560 | 560 | 560 | 560 | 560 | 560 | 560 |

TABLE 4-continued

| | Example of this invention Sample No. | | | | | | | | |
|---|---|---|---|---|---|---|---|---|---|
| | 1 | 2 | 3 | 4 | 5 | 6 | 7 | 8 | 9 |
| Deposited amount of zinc phosphate ($g/m^2$) | 2.15 | 2.15 | 2.19 | 2.21 | 1.87 | 2.44 | 2.26 | 2.21 | 2.20 |
| Electrode tip life* at the time of spot welding (number of spots) | 820 | 820 | 680 | 710 | 600 | 820 | 660 | 650 | 660 |

(Note)
*When welding was carried out continuously at a rate of one spot per 3 seconds and the shear load reached 3,000 kN or less, it was rated as the life.

TABLE 5

| | | Comparative Example Sample No. | | | | | |
|---|---|---|---|---|---|---|---|
| | | 10 | 11 | 12 | 13 | 14 | 15 |
| Alloy | | 1F | 1G | 1H | 1I | 1G | 1G |
| Production method | | I | I | I | I | V | VI |
| Extrusion result | | good | good | good | Center piller was craked | Extrusion was impossible | Center piller was craked |
| Property | Tensile strength (MPa) | 282 | 190 | 311 | — | — | — |
| | Proof stress (MPa) | 201 | 147 | 237 | — | — | — |
| | Elongation (%) | 14.0 | 13.8 | 14.7 | — | — | — |
| | Bendability | good | good | good | — | — | — |
| | Impact absorption energy ($Nm/mm^2$) | 0.034 | 0.023 | 0.040 | — | — | — |
| | Conductivity (IACS %) | 50 | 55 | 45 | — | — | — |
| | Melting start temperature (° C.) | 580 | 610 | 560 | — | — | — |
| | Deposited amount of zinc phosphate ($g/m^2$) | 1.40 | 0.75 | 1.65 | — | — | — |
| | Electrode tip life* at the time of spot welding (number of spots) | 400 | 270 | 700 | — | — | — |

(Note)
*When welding was carried out continuously at a rate of one spot per 3 seconds and the shear load reached 3,000 kN or less, it was rated as the life.

As is apparent from the results shown in Tables 4 and 5, Sample 10 that has a Comparative Example is small impact absorption energy, and the electrode tip life at the time of spot welding is short. Further, the melting start temperature is high, and the deposited amount of zinc phosphate is small, that is, the surface treatment property is poor. Sample 11 is considerably poor in tensile strength and proof stress, it is considerably small in impact absorption energy, and it is therefore impractical in view of the mechanical properties, such as the strength. Further, this Sample 11 has high conductivity and melting start temperature, and it has short electrode tip life at the time of spot welding, and the deposited amount of zinc phosphate (1.8 $g/m^2$ or more is required and 2.0 $g/m^2$ or more is preferable) is as considerably small as 0.75 $g/m^2$. Further, Sample 12 has large tensile strength, elongation, and impact absorption energy, and it is good in weldability, but the deposited amount of zinc phosphate is as small as 1.65 $g/m^2$, and the chemical conversion property is poor.

Thus, Samples 10 to 12 are accompanied by such a problem that one or more of the strength, the impact absorption energy, the weldability (the electrode tip life at the time of spot welding), and the chemical conversion property is poor.

Further, Samples 13 to 15 were conspicuously bad in extrudability, in Samples 13 and 15, the center pillar of the hollow member was broken, and in Sample 14, the extrusion was impossible, and therefore an intended extruded material was not obtained.

In contrast, Samples 1 to 9 of the present invention are excellent in tensile strength and elongation, large in impact absorption energy, and low in conductivity and melting start temperature. In addition, the deposited amount of zinc phosphate that is an indication of the surface treatment property indicates a value of 1.87 to 2.44 $g/m^2$, which is very excellent, the wearing of the electrode tip at the time of spot welding is less and therefore the electrode tip life is long, which means excellent spot weldability.

On the other hand, as is shown in Tables 9 and 10, aluminum alloys, respectively having the compositions of 2A to 2I shown in Table 6, were subjected to soaking and extruding under the conditions of I to VI shown in Table 8, to carry out production tests of aluminum alloy extruded material Samples 16 to 30. After cooling with air using a fan at the time of the extrusion, the samples each were subjected to aging at 180° C. for 2 hours, and then the properties were evaluated. The results are shown in Tables 9 and 10.

Additionally stated, the compositions of ADC12Z, AC4CH, and sash scrap used in 2A to 2C in Table 6, are as shown in Table 7, and the purification was carried out by the α-phase separating treatment method.

The methods for testing the properties were as described above.

TABLE 6

| Type | | Composition (wt %) | | | | | | | | | | | | Remarks |
|---|---|---|---|---|---|---|---|---|---|---|---|---|---|---|
| | | Cu | Fe | Si | Mn | Mg | Cr | V | Ti | Zr | Zn | Sr | Al | |
| Example of this invention | 2A | 0.55 | 0.35 | 3.21 | 0.15 | 0.49 | 0.05 | 0.03 | 0.01 | 0.05 | 0.62 | — | balance | ADC12Z, sash scrap/mixed/purified |
| | 2A' | 0.55 | 0.35 | 3.21 | 0.15 | 0.49 | 0.05 | 0.03 | 0.01 | 0.05 | 0.62 | 100 ppm | balance | ADC12Z, sash scrap/ground metal-mixed/purified |
| | 2B | 0.82 | 0.35 | 2.65 | 0.11 | 0.68 | 0.04 | 0.04 | 0.01 | 0.03 | 0.35 | — | balance | ADC12Z, sash scrap/ground metal-mixed/purified |
| | 2C | 1.05 | 0.85 | 3.95 | 0.08 | 0.99 | 0.07 | 0.06 | 0.01 | 0.10 | 0.31 | — | balance | AC4CH, sash scrap/mixed |
| | 2D | 0.40 | 0.25 | 2.65 | 0.03 | 0.40 | 0.03 | 0.05 | 0.03 | 0.03 | 0.30 | — | balance | |
| | 2E | 1.10 | 1.35 | 3.95 | 0.25 | 1.40 | 0.25 | 0.25 | 0.01 | 0.25 | 1.10 | — | balance | |
| Comparative Example | 2F | 0.45 | 0.33 | 2.20 | 0.01 | 0.35 | 0.03 | 0.02 | 0.00 | 0.03 | 0.00 | — | balance | |
| | 2G | 0.01 | 0.25 | 0.39 | 0.03 | 0.48 | 0.03 | 0.05 | 0.01 | 0.25 | 0.00 | — | balance | |
| | 2H | 0.43 | 0.33 | 2.80 | 0.20 | 0.45 | 0.03 | 0.02 | 0.01 | 0.02 | 0.20 | — | balance | |
| | 2I | 0.55 | 0.31 | 5.12 | 0.82 | 0.45 | 0.03 | 0.05 | 0.00 | 0.03 | 0.00 | — | balance | |

TABLE 7

| Type | Composition (wt %) | | | | | | | | | | |
|---|---|---|---|---|---|---|---|---|---|---|---|
| | Cu | Fe | Si | Mn | Mg | Cr | V | Ti | Zr | Zn | Al |
| ADC12Z | 2.2 | 1.10 | 11.2 | 0.30 | 0.09 | 0.02 | 0.01 | 0.01 | 0.01 | 1.83 | balance |
| AC4CH | 0.12 | 0.14 | 6.7 | 0.01 | 0.36 | 0.03 | 0.01 | 0.01 | 0.01 | 0.05 | balance |
| sash scrap | 0.01 | 0.78 | 0.65 | 0.18 | 0.48 | 0.01 | 0.00 | 0.01 | 0.00 | 0.00 | balance |

TABLE 8

| | Production method | | | | | |
|---|---|---|---|---|---|---|
| | I | II | III | IV | V | VI |
| Homogenizing treatment | 530° C. × 4 hours | | | 540° C. × 4 hours + 450° C. × 4 hours | 530° C. × 4 hours | |
| Die * | hollow 1 | solid/hollow 2 | hollow 1/TIN coat | hollow 1 | hollow 1 | hollow 1 |
| Extrusion billet temperature | 400° C. | 450° C. | 400° C. | 400° C. | 300° C. | 520° C. |
| Extrusion speed | 45 mpm | 40 mpm | 48 mpm | 52 mpm | — | 38 mpm |
| Extruded state | good | good | good | good | Extrusion was impossible | Cracks appeared |

(Note)
* Die
Hollow 1: B-shaped, 40 mm on each side, 2.0 mm thickness, made of a high speed steel
Hollow 2: Square, 40 mm on each side, 2.0 mm thickness, made of a high speed steel
Solid: 2.0 t × 100 W
TiN coat: The bearing part had a coat 1 μm in thickness, and the basis material was a high speed steel

TABLE 9

| | | Example of this invention Sample No. | | | | | | | | |
|---|---|---|---|---|---|---|---|---|---|---|
| | | 16 | 17 | 18 | 19 | 20 | 21 | 22 | 23 | 24 |
| Alloy | | 2A | 2A' | 2B | 2C | 2D | 2E | 2A | 2A | 2A |
| Production method | | I | I | I | I | I | I | II | III | IV |
| Extrusion result | | good | good | good | good | good | good | good | good | good |
| Property | Tensile strength (MPa) | 289 | 294 | 298 | 305 | 278 | 339 | 290 | 289 | 291 |
| | Proof stress (MPa) | 207 | 213 | 215 | 219 | 200 | 255 | 208 | 209 | 210 |
| | Elongation (%) | 16.5 | 16.8 | 16.4 | 15.9 | 17.0 | 14.3 | 16.4 | 16.3 | 16.4 |
| | Bendability | good | good | good | good | good | good | good | good | good |
| | Conductivity (IACS %) | 48 | 48 | 48 | 47 | 49 | 46 | 48 | 48 | 48 |
| | Melting start temperature (° C.) | 560 | 560 | 560 | 560 | 560 | 560 | 560 | 560 | 560 |

TABLE 9-continued

| | Example of this invention Sample No. | | | | | | | | |
|---|---|---|---|---|---|---|---|---|---|
| | 16 | 17 | 18 | 19 | 20 | 21 | 22 | 23 | 24 |
| Deposited amount of zinc phosphate ($g/m^2$) | 2.25 | 2.25 | 2.19 | 2.21 | 1.87 | 2.44 | 2.26 | 2.21 | 2.20 |
| Electrode tip life* at the time of spot welding (number of spots) | 680 | 695 | 680 | 710 | 600 | 820 | 660 | 650 | 660 |

(Note)
*When welding was carried out continuously at a rate of one spot per 3 seconds and the shear load reached 3,000 kN or less, it was rated as the life.

TABLE 10

| | | Comparative Example Sample No. | | | | | |
|---|---|---|---|---|---|---|---|
| | | 25 | 26 | 27 | 28 | 29 | 30 |
| Alloy | | 2F | 2G | 2H | 21 | 2G | 2G |
| Production method | | I | I | I | I | VI | |
| Extrusion result | | good | good | good | Center piller was cracked | Extrusion was impossible | Center piller was cracked |
| Property | Tensile strength (MPa) | 278 | 194 | 313 | — | — | — |
| | Proof stress (MPa) | 203 | 147 | 237 | — | — | — |
| | Elongation (%) | 15.6 | 14.9 | 15.2 | — | — | — |
| | Bendability | good | good | good | — | — | — |
| | Conductivity (IACS %) | 51 | 54 | 47 | — | — | — |
| | Melting start temperature (° C.) | 580 | 610 | 560 | — | — | — |
| | Deposited amount of zinc phosphate ($g/m^2$) | 1.40 | 0.75 | 1.65 | — | — | — |
| | Electrode tip life* at the time of spot welding (number of spots) | 400 | 270 | 700 | — | — | — |

(Note)
*When welding was carried out continuously at a rate of one spot per 3 seconds and the shear load reached 3,000 kN or less, it was rated as the life.

As is apparent from the results shown in Tables 9 and 10, Sample 29, a Comparative Example, is conspicuously bad in extrudability and is impossible to be extruded; and in Samples 28 and 30, the center pillar of the hollow material breaks and the intended extruded material was not obtained. Although in Sample 25 the extrusion result is good, the deposited amount of zinc phosphate is small and the chemical conversion property is also poor. Further, the electrode tip life at the time of spot welding is very short. In Sample 26, the electrode tip life at the time of spot welding is conspicuously as short as 270, the deposited amount of zinc phosphate is 0.75 $g/m^2$ that is very small, and the melting start temperature is as high as 610° C. In Sample 27, the deposited amount of zinc phosphate is small and the chemical conversion property is poor.

In contrast, in Samples 16 to 24 of the present invention, the tensile strength, the proof stress, and the elongation are excellent, and the conductivity and the melting start temperature are low. Further, the deposited amount of zinc phosphate that is an indication of the surface treatment property indicates a value of 1.87 $g/m^2$ or more, which is very excellent, and the electrode tip life at the time of spot welding is long, from which it can be understood that the wearing of the electrode tip is less. Industrial Applicability The aluminum alloy extruded material for structural members of automotive bodies of the present invention is favorably suitable to be used as structural members of automotive bodies, such as a side frame, a rear frame, a center pillar, a side sill, and a floor frame, from the standpoint: since the conductivity and the melting start temperature are low, an electrode tip is less worn at the time of spot welding and therefore the improvement in the productivity in the assembling step can be attained; since the degreasing property and the chemical conversion property are good, the surface treatment property is excellent; since the mechanical strength is high and the impact absorption energy is large, the thickness may be reduced; and/or since the bendability is high, cracks do not appear when high-degree bending is carried out.

Further, the method for producing an aluminum alloy extruded material for structural members of automotive bodies of the present invention is favorably suitable as a method for producing an extruded material having the above excellent properties, at a low cost, using recycled aluminum materials as a raw material.

Further, the aluminum alloy extruded material for structural members of automotive bodies of the present invention is favorably suitable in the application of recycling of aluminum discarded materials, since, as at least part of the raw material, recycled aluminum materials can be used.

Having described our invention as related to the present embodiments, it is our intention that the invention not be limited by any of the details of the description, unless otherwise specified, but rather be construed broadly within its spirit and scope as set out in the accompanying claims.

What is claimed is:

1. An aluminum alloy extruded material for structural members of automotive bodies, which is composed of an aluminum alloy consisting essentially of more than 2.6% by weight but 4.0% by weight or less of Si, more than 0.3% by weight but 1.5% by weight or less of Mg, more than 0.3% by weight but 1.2% by weight or less of Mn, more than 0.3% by weight but 1.2% by weight or less of Zn, more than 0.2% by weight but 1.2% by weight or less of Cu, more than 0.1% by weight but 1.5% by weight or less of Fe, 50–500 ppm of Sr or Sb, and a balance being made of Al and unavoidable impurities, having a conductivity of 48% or less based on IACS and a melting point temperature of 570° C. or less, and said aluminum alloy extruded material contains at least one recycled material selected from the group consisting of scraps recycled from aluminum cans and scraps of automotive aluminum parts, as at least a part of the aluminum alloy, wherein after an aluminum alloy ingot is subjected to a homogenizing treatment at a billet temperature of 520–570° C. for 1 hour or more, the aluminum alloy ingot is subjected to a homogenizing treatment by keeping the aluminum alloy ingot at a temperature of 400–520° C. for 1 hour or more, and thereafter the aluminum alloy ingot is cooled, heated and subjected to hot extrusion at a billet temperature of 330–500° C.

2. The aluminum alloy extruded material for structural members of automotive bodies as claimed in claim 1, wherein scraps recycled from aluminum cans containing more than 0.5% by weight but 1.2% by weight or less of Mn and more than 1.2% by weight but 2.0% by weight or less of Mg and scraps of automotive aluminum parts containing more than 2.5% by weight but 14% by weight or less of Si are used for at least a part of the aluminum alloy ingot.

3. The aluminum alloy extruded material for structural members of automotive bodies as claimed in claim 1, wherein the aluminum alloy extruded material has a tensile strength of 309 to 365 MPa.

4. The aluminum alloy extruded material for structural members of automotive bodies as claimed in claim 1, wherein the aluminum alloy extruded material has a proof stress of 230 to 278 MPa.

5. The aluminum alloy extruded material for structural members of automotive bodies as claimed in claim 1, wherein the aluminum alloy extruded material has an impact adsorption energy about 0.04 $Nm/mm^2$ or greater.

6. The aluminum alloy extruded material for structural members of automotive bodies as claimed in claim 1, wherein the aluminum alloy extruded material has an elongation of 13.8 to 15.6%.

7. The aluminum alloy extruded material for structural members of automotive bodies as claimed in claim 1, wherein the recycled material is subjected to a purification treatment.

8. A method for producing the aluminum alloy extruded material for structural members of automotive bodies as claimed in claim 1, which comprises:

providing the aluminum alloy ingot by mixing with an aluminum ingot the at least one recycled material selected from the group consisting of scraps recycled from aluminum cans and scraps of automotive aluminum parts, as at least part of the aluminum alloy ingot;

subjecting the aluminum alloy ingot to the homogenizing treatment at a billet temperature of over 520° C. but 570° C. or less for 1 hour or more;

subjecting the aluminum alloy ingot to the homogenizing treatment by keeping the aluminum alloy ingot at a temperature of over 400° C. but 520° C. or less for 1 hour or more; and thereafter the aluminum alloy ingot is cooled, heated again, and subjected to hot extrusion at a billet temperature of over 330° C. but 500° C. or less.

9. The method for producing the aluminum alloy extruded material for structural members of automotive bodies as claimed in claim 8, wherein at least a part of a material-sliding-surface of an extrusion die is coated with ceramics.

10. The method of producing the aluminum alloy extruded material structural members of automotive bodies as claimed in claim 8, which further comprises:

purifying the recycled material.

11. An aluminum alloy extruded material for structural members of automotive bodies, which comprises an aluminum alloy containing more than 2.6% by weight but 4.0% by weight or less of Si, more than 0.3% by weight but 1.5% by weight or less of Mg, more than 0.3% by weight but 1.2% by weight or less of Zn, more than 0.3% by weight but 1.2% by weight or less of Cu, more than 0.1% by weight but 1.5% by weight or less of Fe, 50–500 ppm of Sr or Sb, and containing at least one selected from the group consisting of Mn in an amount of more than 0.01% by weight but 0.3% by weight or less, Cr in an amount of more than 0.01% by weight but 0.3% by weight or less, Zr in an amount of more than 0.01% by weight but 0.3% by weight or less, and V in an amount of more than 0.01% by weight but 0.3% by weight or less, and a balance being made of Al and unavoidable impurities, the alloy having a conductivity of 50% or less based on IACS and a melting start temperature of 570° C. or less, and said aluminum alloy extruded material contains at least one recycled material selected from the group consisting of scraps recycled from aluminum sashes and scraps of automotive aluminum parts, as at least a part of the aluminum alloy, wherein after an aluminum alloy ingot is subjected to a homogenizing treatment at a billet temperature of 520–570° C. for 1 hour or more, the aluminum alloy ingot is subjected to a homogenizing treatment by keeping the aluminum alloy ingot at a temperature of 400–520° C. for 1 hour or more, and thereafter the aluminum alloy ingot is cooled, heated and subjected to hot extrusion at a billet temperature of 330–500° C.

12. The aluminum alloy extruded material for structural members of automotive bodies as claimed in claim 11, wherein after an aluminum alloy ingot is subjected to a homogenizing treatment at a billet temperature of over 520° C. but 570° C. or less for 1 hour or more, it is subjected to a homogenizing treatment by keeping it at a temperature of over 400° C. but 520° C. or less for 1 hour or more, and thereafter it is cooled, heated again, and subjected to hot extrusion at a billet temperature of over 330° C. but 500° C. or less, wherein scraps recycled from aluminum sashes containing more than 0.2% by weight but 1.0% by weight or less of Mg and scraps of automotive aluminum parts containing more than 2.5% by weight but 14% by weight or less of Si are used for at least a part of the aluminum alloy ingot.

13. A method for producing the aluminum alloy extruded material for structural members of automotive bodies as claimed in claim 11, which comprises:

providing the aluminum alloy ingot by mixing with an aluminum ingot the at least one recycled material selected from the group consisting of scraps recycled from aluminum sashes and scraps of automotive aluminum parts, as at least part of the aluminum alloy ingot;

subjecting the aluminum alloy ingot to the homogenizing treatment at a billet temperature of over 520° C. but 570° C. or less for 1 hour or more;

subjecting the aluminum alloy ingot to the homogenizing treatment by keeping the aluminum alloy ingot at a temperature of over 400° C. but 520° C. or less for 1 hour or more; and thereafter the aluminum alloy ingot is cooled, heated again, and subjected to hot extrusion at a billet temperature of over 330° C. but 500° C. or less.

14. The method for producing the aluminum alloy extruded material for structural members of automotive bodies as claimed in claim 13, wherein at least a part of a material-sliding-surface of an extrusion die is coated with ceramics.

15. The method for producing the aluminum alloy extruded material for structural members of automotive bodies as claimed in claim 13, which further comprises:

purifying the recycled material.

16. The aluminum alloy extruded material for structural members of automotive bodies as claimed in claim 11, wherein the recycled material is subjected to a purification treatment.

17. An aluminum alloy extruded material for structural members of automotive bodies, which comprises an aluminum alloy containing more than 2.6% by weight but 4.0% by weight or less of Si, more than 0.3% by weight but 1.5% by weight or less of Mg, more than 0.3% by weight but 1.2% by weight or less of Mn, more than 0.3% by weight but 1.2% by weight or less of Zn, more than 0.2% by weight but 1.2% by weight or less of Cu, and more than 0.1% by weight but 1.5% by weight or less of Fe, 50–500ppm of Sr or Sb, and a balance being made of Al and unavoidable impurities, having a conductivity of 48% or less based on IACS and a melting point temperature of 570° C. or less.

18. An aluminum alloy extruded material for structural members of automotive bodies, which comprises an aluminum alloy containing more than 2.6% by weight but 4.0% by weight or less of Si, more than 0.3% by weight but 1.5% by weight or less of Mg, more than 0.3% by weight but 1.2% by weight or less of Zn, more than 0.3% by weight but 1.2% by weight or less of Cu, and more than 0.1% by weight but 1.5% by weight or less of Fe, and containing at least one selected from the group consisting of Mn in an amount of more than 0.01% by weight but 0.3% by weight or less, Cr in an amount of more than 0.01% by weight but 0.3% by weight or less, Zr in an amount of more than 0.01% by weight but 0.3% by weight or less, and V in an amount of more than 0.01% by weight but 0.3% by weight or less, 50–500ppm of Sr or Sb, and a balance being made of Al and unavoidable impurities, the alloy having a conductivity of 50% or less based on IACS and a melting start temperature of 570° C. or less.

* * * * *